United States Patent [19]

Taylor et al.

[11] 4,296,713

[45] Oct. 27, 1981

[54] VAPOR GENERATOR

[75] Inventors: Edward S. Taylor, Del Mar, Calif.; George W. Hirschle, Wiesendangen, Switzerland

[73] Assignee: General Atomic Company, San Diego, Calif.

[21] Appl. No.: 10,090

[22] Filed: Feb. 7, 1979

[51] Int. Cl.[3] ..... F22B 1/18

[52] U.S. Cl. ..... 122/32; 122/483; 122/510; 122/DIG. 16; 165/162

[58] Field of Search ..... 122/32, 33, 34, 483, 122/510, DIG. 16; 165/81, 82, 162, 163; 176/38

[56] References Cited

U.S. PATENT DOCUMENTS

| | | | |
|---|---|---|---|
| 3,199,582 | 8/1965 | Vogt et al. | 165/69 |
| 3,456,621 | 7/1969 | Bell et al. | 122/32 |
| 3,520,356 | 7/1970 | Bell et al. | 165/134 |
| 3,575,236 | 4/1971 | Romanos | 165/162 |
| 3,628,507 | 12/1971 | Saporiti | 122/32 |
| 3,885,621 | 5/1975 | Slebodnick | 165/110 |
| 3,942,482 | 3/1976 | Barratt et al. | 122/32 |
| 4,005,681 | 2/1977 | Lockett | 122/32 |
| 4,047,506 | 9/1977 | Weber | 122/32 |
| 4,073,267 | 2/1978 | Hunt et al. | 122/32 |
| 4,088,184 | 5/1978 | Cavallaro | 165/162 |

*Primary Examiner*—Edward G. Favors

*Attorney, Agent, or Firm*—Fitch, Even, Tabin, Flannery & Welsh

[57] ABSTRACT

A vapor generator is described wherein cross-over loops joining two different tube bundles are positioned in a stagnant area out of the flow of the heating fluid, thus reducing the tube metal temperatures in a highly stressed area. Tube anchor devices are provided to reduce expansion movement and stresses while permitting some relative movement and providing support during seismic disturbances.

7 Claims, 4 Drawing Figures

VAPOR GENERATOR

This invention relates to vapor generators and, more particularly, to a vapor generator having an improved arrangement for supporting and interconnecting coaxial tube bundles therein.

Since the advent of nuclear power reactors, substantial steps have been taken toward the efficient and economical production of electrical power from thermal energy derived by these reactors. An important factor in the attainment of this goal is the operation of such reactors at temperatures sufficiently high to enable the direct production of steam at temperatures and pressures suitable for high efficiency operation of steam turbines. In this connection, present day reactor technology has lead to the development of high temperature gas-cooled reactors which, when employed with a suitable steam turbine system, have the capability of producing electrical power of a quantity and at a cost which meet requirements of the utility industry.

In general, nuclear power plants employing high temperature gas-cooled reactors enclose the reactor in a pressure vessel through which a gas coolant, such as helium or carbon dioxide, is circulated to withdraw thermal energy liberated by the reactor. Steam for the operation of the turbines is normally obtained by the transfer of heat from the coolant to the fluid of a water/steam system. Conventionally, such heat transfer is accomplished in a steam generator wherein the thermal energy withdrawn from the reactor is utilized to produce superheated steam.

In such a gas-cooled reactor system, it is frequently desirable that the gas make only a single pass through the steam generator before being returned to the reactor. It is therefore important that the greatest possible amount of heat be withdrawn from the gas in order to achieve maximum efficiency. It is also important, however, that there be as little restriction as possible to gas flow in order that work expended in transporting the gas through the system be held to a minimum. Where, for various reasons including structural economy, the steam generator is included in the same pressure containment vessel as the reactor itself, it is also important that the size of the generator be minimized and that the steam generator or sections thereof be readily removable and replaceable through necessarily restricted openings in the containment vessel. Finally, for reasons of structural economy and plate efficiency, it is necessary to have steam pressure exceed primary coolant pressures. To limit pressure buildup in the primary coolant in the event of a steam/primary coolant boundary failure, large steam pipes are terminated at the reactor vessel wall and interconnected with the heat exchanger bundles by tubing in order to limit or minimize the amount of leakage.

Where the steam generator is contained in a special cavity within a prestressed concrete reactor vessel, the routing of unheated tubing from pipe connections at the reactor vessel wall to the ends of the tube bundles results in uneconomical use of both tubing and reactor vessel cavity volume. Accordingly, designs have been developed using cross-over tube connections between the low temperature and high temperature sections and the reheater sections at the ends thereof opposite the steam/water pipe connections. This reverses the general direction of water/steam flow and minimizes the lengths of unheated tubing.

A problem in the design of steam generators of the type described is that tubes therein of different configurations and lengths frequently have different thermal expansion characteristics. Cross-over connections between tubes of different types therefore must allow for a certain degree of differential expansion. To provide for this, prior art constructions sometimes have required complex and intertwining arrangements of unheated tube sections, thereby joining steam generator and reheater sections into one large assembly. By locating thermal expansion means at the cross-overs, the complex intertwining may be eliminated and manufacturing times significantly reduced.

Certain types of vapor generators employ tube bundles in which the tubes are of different configurations or different lengths, or are subjected to different temperatures. Under such circumstances, thermal expansion of the individual tube bundles between different operating conditions or between the shutdown condition and the operating condition may be substantially different. Where the tube bundles are interconnected, such thermal expansion of different amounts may produce relatively high stresses on the interconnecting tubes.

In many vapor generator designs, the necessity for accommodating thermal expansion of different amounts has resulted in the use of interconnecting coils of helical shape. The stresses resulting from the thermal expansion of different amounts are applied to the interconnecting tubes as torsion loading. Because the whole of the material volume in the tube is in the most highly stressed area, the greatest deflection is possible for a given stress value and material volume.

Although the use of helical connecting tubes in some situations may be easily achieved, other vapor generator design configurations may take the employment of helical interconnecting tubes difficult. For example, where tube bundles are side by side or are nested coaxially, some section of the interconnecting tubes must necessarily extend transversely of the direction of thermal expansion. High stresses resulting from thermal expansion of different amounts may be difficult to accommodate in the horizontal section of the interconnecting tubes.

It is an object of the present invention to provide an improved vapor generator.

Another object of the invention is to provide an improved vapor generator wherein thermal expansion of different amounts between interconnected tube bundles is readily accommodated.

A further object of the invention is to provide a vapor generator having interconnected tube bundles subject to thermal expansion of different amounts wherein stresses on the interconnecting tubes as a result of such differential thermal expansion are minimized.

Other objects of the invention will become apparent to those skilled in the art from the following description, taken in connection with the accompanying drawings, wherein:

FIG. 1 is a schematic side view in full cross-section of a vapor generator constructed in accordance with the invention;

FIG. 2, on the second sheet of drawings, is a greatly enlarged cross-sectional schematic view of a portion of the top part of the vapor generator of FIG. 1;

Very generally, the vapor generator of the invention comprises a high temperature section 12 having a plurality of substantially straight tubes substantially parallel with each other and forming an elongated tube bundle. A low temperature section 11 is also provided having a plurality of substantially helical tubes forming an annular tube bundle positioned coaxially of the high temperature section. The tubes of the high temperature section and the tubes of the low temperature section are comprised of different metals having different coefficients of thermal expansion. The high temperature and low temperature sections are subject to thermal expansion of different amounts. A heating fluid is directed through the tube bundles, respectively, in opposite directions and means 13 are provided for turning the heating fluid through a substantially 180° turn at one end of the vapor generator. The tubes in the high temperature and low temperature sections are joined, respectively, by a plurality of cross-over loops 15, each of which has portions of different metals joined to respective sections. The cross-over loops each have a bimetal weld joining the portions of different metals and the bimetal welds are positioned in a stagnant area out of the main flow of heating fluid.

Figure 1:
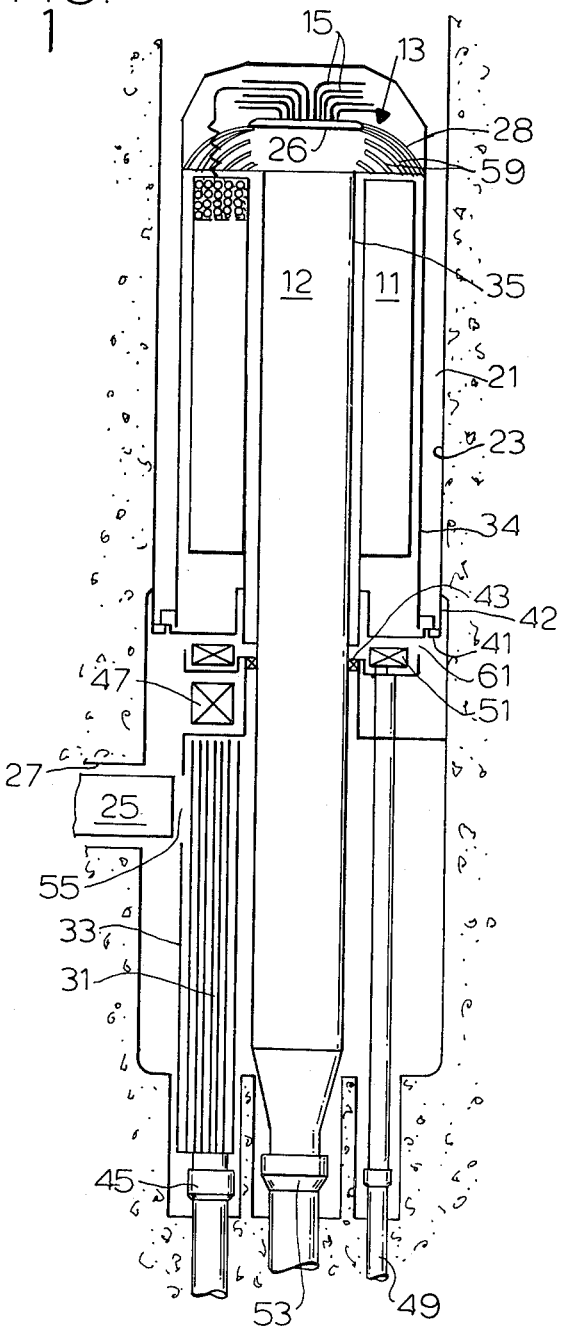

Referring now more particularly to FIG. 1, the schematic diagram therein is that of a steam generator such as may be employed in a nuclear reactor. The generator is mounted within a well 21 formed in the prestressed concrete reactor pressure vessel 23 for the reactor core, not shown. Hot gas is supplied to the steam generator through a conduit 25 positioned in a duct 27 of the reactor vessel 23. The gas circulates through the steam generator and passes upwardly thereof to a gas circulator (not shown) positioned in the well 21 above the steam generator. The gas circulator then returns the gas to the reactor core through suitable ducting, not shown.

The illustrated steam generator includes banks or bundles 31 of reheater tubes positioned toward the lower end of a well 21 and framed by suitable housing 33 of metal plates or the like. Positioned above the reheater tube bundle is a bundle of helical coils nested together to form an annular shape and comprising the annular bundle 11. The bundle 11 is provided with a housing 34 of metal plates or the like. The bundle 11 may comprise the economizer-evaporator and first superheater section of the steam generator.

The second superheater section is the tube bundle 12 comprised of a plurality of elongated straight tubes which are positioned in the space defined by both the tube bundles 31 and the annular tube bundle 11. A housing 35, comprised of suitable metallic plates or the like, is formed surrounding the tube bundle 12. The housings 34 and 35 are suitably supported by a mounting flange 41 mounted within the well 21 on the cavity liner 42. Differential thermal expansion is accommodated by an annular sliding seal indicated at 43.

Hot and cold reheater fluids are supplied to and exit from the reheat tube bundles 31 by suitable headers 45. The hot reheat and cold reheat tubes of the reheater tube bank are interconnected by hairpin shaped cross-over tubes indicated generally at 47.

Feed water for the steam generator illustrated is supplied through a feed water input conduit 49 which passes upwardly through the lower portion of the steam generator and connects with the tubes in the tube bundle 11 through expansion leads 51. Outflow at the top of the tube bundle 11 passes to the upper end of the tube bundle 12 as will be explained in detail subsequently. Superheated steam exits the lower end of the tube bundle 12 through the superheater header 53.

Incoming hot gas from the reactor core enters the penetration through the duct 27 and conduit 25 and passes through an opening 55 in the housing 33 for the reheat tube bundles 31. After circulating over the tubes in the bundles 31, the gas enters the open lower end of the housing 35 and passes upwardly over the tubes in the tube bundle 12. The turning means 13 comprise a gas flow deflection plate 26 and a duct or vane 28 suitably mounted at the upper end of the housing 35 and a plurality of fins 59 to assist in directing the gas. The gas passes through the space between the upper open end of the housing 35 and the plate 13 between the fins 59 and is then directed downwardly over the helical tubes in the tube bundle 11. After passing over the helical tubes in the tube bundle 11, the gas passes through the ports 61 in the outer wall of the housing 34 and passes upwardly between the housing 34 and the liner of the penetration 21 to the gas circulator, not shown.

Figure 2:
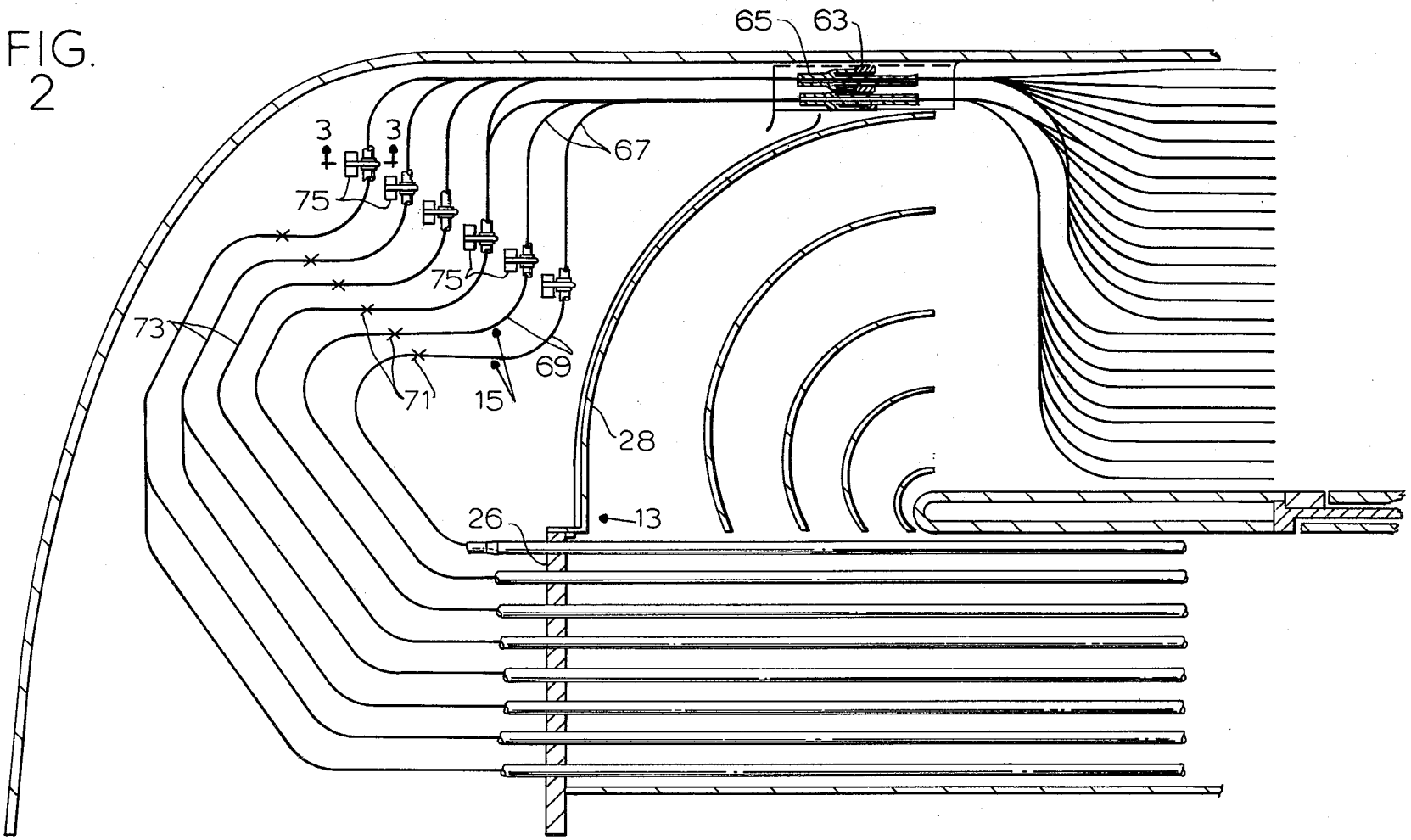

Outflow at the top of the tube bundle 11 passes to the upper end of the tube bundle 12 through a plurality of cross-over tubes 15 which are flexible to accommodate differences in thermal expansion between the tube bundles 11 and 12. Referring more particularly to FIG. 2, the details of the cross-over tube arrangement may be more easily seen. The cross-over tubes extend vertically upward in rows closely arranged at the outer periphery of the vapor generator by suitably routing the helical tubes at the upper ends of the tube bundle 11. The vertical sections of the cross-over tubes adjacent the upper end of the tube bundle 11 are anchored to each other and to the outer shroud by means of an outer support ring 63. The tubes themselves pass through suitable openings in the outer support ring 63 and are anchored to the outer support ring by sleeves 65 which surround the tubes coaxially therewith. By utilizing the outer support ring 63 as shown, expansion movement and stresses within the tube leadouts from the helical tube bundle 11 are significantly reduced.

The vertical leadouts from the helical tube bundle 11 extend upwardly beyond the turning vane 28 to a level in the stagnant region above the plate 26. A 90° bend 67 is then provided in each of the cross-over tubes such that the tubes extend inwardly about half the distance from the outer shroud to the periphery of the top plate 26. The tubes then are once again provided with a 90° bend 69 in the opposite direction to resume the vertical orientation of the tubes for a short distance. In this vertical linear section, the bimetal welds 71 are provided joining the two sections of the tubes of dissimilar metals. One of these metals comprises the metal of which the helical tube bundle 11 is comprised, whereas the other of the two dissimilar metals is the same metal as that of which the straight tubes of the superheater bundle are comprised. The cross-over loops then continue through an unbalanced 180° turn it the loop portions 73 to join with the upper ends of the respective superheater tubes in the superheater bundle 11. By providing the bimetal welds located as shown, the welds are located in a stagnant lower temperature portion of the steam generator. This substantially reduces the thermal stresses on the welds.

For the purpose of providing support for the expansion loops during a seismic disturbance, while, at the same time, permitting sufficient relative movement of the loops so as to accommodate thermal expansion and contraction, the vapor generator of the invention utilizes a plurality of floating rings 75. These floating rings join groups of each of the expansion loops 15 as illustrated in FIG. 2 while at the same time enabling sufficient movement of the loops to accommodate the changes due to thermal expansion and contraction.

Figure 3:
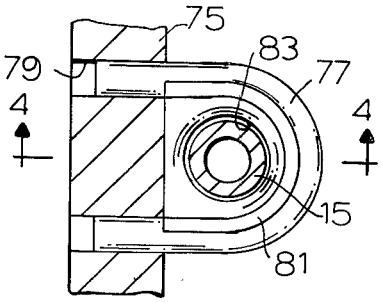
FIG. 3 is a sectional view taken along the line 3—3 of FIG. 2.
Figure 4:
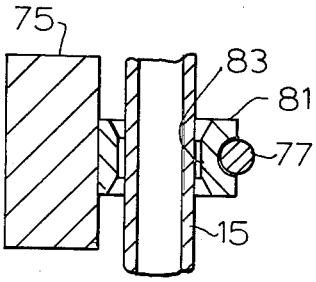
FIG. 4 is a sectional view taken along the line 4—4 of FIG. 3.

Referring more particularly to FIGS. 3 and 4, the nature of the floating rings and their connections may be more clearly seen. A U-shaped bar 77 anchors each expansion loop to the corresponding floating ring in openings 79 provided therein. Each of the U-shaped bars or connections 77 surrounds a split clamping device 81 positioned against the floating rings 75 and through which the associated cross-over loops 15 extend. An opening 83 having beveled edges at both sides passes through the clamping device and permits axial movement of the cross-over tubes 15 within the openings. Accordingly, during a seismic disturbance, support is provided for the cross-over loops whereas thermal expansion and contraction are still accommodated.

It may be seen therefore that the invention provides an improved vapor generator wherein thermal expansion and contraction are easily accommodated, protection for bimetal welds in the cross-over loops is provided, and adequate support during seismic disturbances is accomplished.

Various modifications of the invention in addition to those shown and described herein will become apparent to those skilled in the art from the foregoing description and accompanying drawings. Such modifications are intended to fall within the scope of the appended claims.

What is claimed is:

1. A vapor generator comprising, a high temperature section having a plurality of substantially straight tubes substantially parallel with each other forming an elongated tube bundle, a low temperature section having a plurality of substantially helical tubes forming an annular tube bundle positioned axially of said high temperature section, said tubes of said low temperature section being comprised of different metals having different coefficients of thermal expansion, said high temperature and low temperature sections being subject to thermal expansion of different amounts, means for directing a heating fluid through one of said tube bundles substantially parallel to the coaxes of said bundles and then through the other of said tube bundles in the opposite direction, said directing means including plate means extending transversely at one end of said vapor generator for turning the heating fluid through a substantially 180° turn, and a plurality of cross-over loops joining the tubes in said high temperature section to the tubes in said low temperature section, said cross-over loops each having portions of said different metals joined, respectively, to said section having the same metal, said cross-over loops each having a bimetal weld joining said portions of different metals, said bimetal welds being positioned on opposite sides of said plate means from said high temperature and low temperature sections to be out of the flow of the heating fluid.

2. A vapor generator according to claim 1 wherein said plate means include a substantially flat plate extending transversely of the coaxes of said sections, and a plurality of vanes positioned adjacent said plate and shaped to provide a substantially laminar flow of the coolant through a 180° turn.

3. A vapor generator according to claim 1 wherein said plate means extend substantially entirely across the vapor generator to prevent flow of coolant beyond same and thus create a stagnant region for said cross-over loops.

4. A vapor generator according to claim 1 including an outer support ring securing said cross-over loops, at the ends thereof adjacent said low temperature bundle, to said directing means.

5. A vapor generator according to claim 1 including a floating ring positioned on the side of said plate means opposite said sections and securing said cross-over loops to each other.

6. A vapor generator comprising, a high temperature section having a plurality of substantially straight tubes substantially parallel with each other forming an elongated tube bundle, a low temperature section having a plurality of substantially helical tubes forming an annular tube bundle positioned coaxially of said high temperature section, an outer duct comprising a substantially cylindrical sleeve surrounding and enclosing both of said high temperature and low temperature sections, an inner duct comprising a substantially cylindrical sleeve surrounding and enclosing only one of said high temperature and low temperature sections and being positioned coaxially of said outer duct, said ducts comprising means for directing a heating fluid through one of said tube bundles substantially parallel to the coaxes of said bundles and then through the other of said tube bundles in the opposite direction, said directing means including means for turning the heating fluid through a substantially 180° turn, a plurality of cross-over loops joining the tubes in said high temperature section to the tubes in said low temperature section, an outer support ring securing said cross-over loops, at the end thereof adjacent said low temperature bundle, to said outer duct, and at least one floating ring positioned on the side of said plate means opposite said sections and securing said cross-over loops to each other.

7. A vapor generator according to claim 6 wherein said cross-over loops are secured to said floating ring by means of at least one U-shaped bar and a split clamping device such that said cross-over loops are free to move axially with respect to said split clamping device.

* * * * *